US007290369B2

(12) United States Patent
Tarrega Lloret

(10) Patent No.: US 7,290,369 B2
(45) Date of Patent: Nov. 6, 2007

(54) DEVICE FOR THE SYNCHRONIZED ACTUATION OF SLIDING DOORS

(75) Inventor: Miguel Angel Tarrega Lloret, Barcelona (ES)

(73) Assignee: Klein Iberica, S.A. (ES)

( * ) Notice: Subject to any disclaimer, the term of this patent is extended or adjusted under 35 U.S.C. 154(b) by 136 days.

(21) Appl. No.: 11/016,589

(22) Filed: Dec. 17, 2004

(65) Prior Publication Data

US 2005/0160672 A1 Jul. 28, 2005

(30) Foreign Application Priority Data

Dec. 18, 2003 (ES) ..... 200303001

(51) Int. Cl.
*E05C 7/06* (2006.01)

(52) U.S. Cl. ..... 49/123; 49/118; 49/410; 49/411; 49/360; 49/409

(58) Field of Classification Search ..... 49/116, 49/118, 123, 147, 360, 370, 40, 410, 411, 49/409; 52/204.52, 207, 243.1, 590.1
See application file for complete search history.

(56) References Cited

U.S. PATENT DOCUMENTS 4,457,108 A * 7/1984 Kuschel et al. ..... 49/213
4,503,637 A * 3/1985 Parente ..... 49/141
4,785,579 A * 11/1988 Sugiyama et al. ..... 49/40
4,991,347 A * 2/1991 Takimoto et al. ..... 49/40
5,271,181 A * 12/1993 Pietro ..... 49/118
6,131,340 A * 10/2000 Clark et al. ..... 49/410
6,910,301 B2 * 6/2005 Kalempa et al. ..... 49/368

* cited by examiner

*Primary Examiner*—Jerry Redman
(74) *Attorney, Agent, or Firm*—Ostrolenk, Faber, Gerb & Soffen, LLP

(57) ABSTRACT

A device for the synchronized actuation of sliding doors, provided for two sliding doors moving indistinctly in the same plane or in two planes forming any angle, consisting of two pairs of cogwheels (8-8') and (9-9') between which there is arranged, inside of each pair, an also cog belt (10-10'), a connection part (13-13') fixed to the corresponding suspension grip (6-6') of the respective sliding door being joined to each one of these belts. Joined to the two neighboring cogwheels (9-9') there are respective cogwheels (18-18') of a larger diameter, directly meshing with one another, to synchronously transmit motion from one cog belt (10-10') to the other, cogwheels (18-18') which are kept joined by means of parts (20) bridging their shafts (19-19') and maintaining the drive transmission both when the doors are coplanar and when they form any angle.

7 Claims, 10 Drawing Sheets

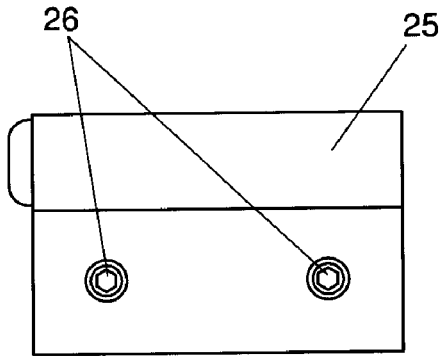
FIG. 10
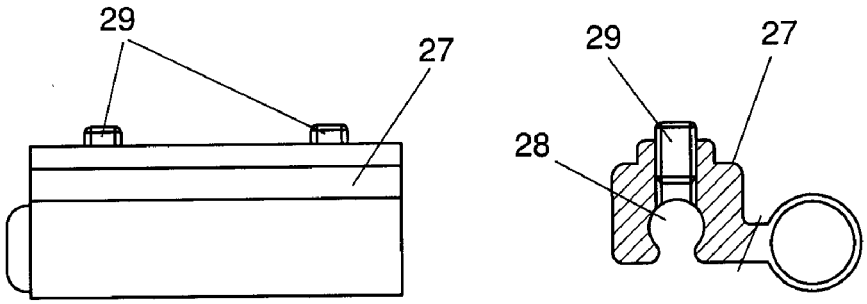
FIG. 11
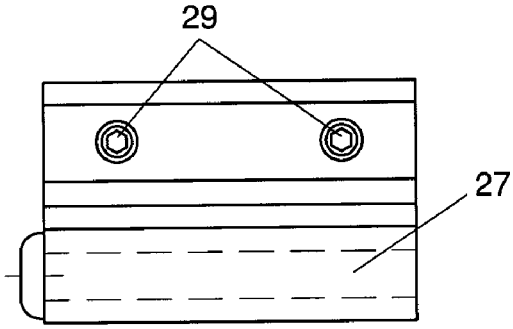

DEVICE FOR THE SYNCHRONIZED ACTUATION OF SLIDING DOORS

OBJECT OF THE INVENTION

The present invention refers to a device especially designed for the synchronized actuation of two sliding doors, preferably two glass doors, such that the opening/closing motion supplied to one of them, by any means, both manual and mechanized, is transmitted synchronously to the other one.

The invention is indistinctly applicable to sliding doors shifting on the same plane, and to sliding doors functioning in different planes, with any angle, such as, for example, those corresponding to a corner of a room.

The invention is especially suitable for being applied to sliding glass doors, shiftable with regard to respective fixed panels, also of glass, framing the passage area including said doors.

BACKGROUND OF THE INVENTION

The same applicant is owner of Spanish patent application number 9600632, which discloses a mechanism for sliding glass doors in which an upper rail and a lower guide parallel to the former participate, between which a fixed leaf and a shiftable leaf are situated, the upper rail, starting from a general inverted L-shape, having means for attaching stops limiting the run of the shiftable leaf, a rib which is longitudinal and oriented upward for the shifting of wheels associated to the shiftable leaf, and said shiftable leaf especially having a pair of suspension heads, in addition to incorporating respective wheels, each one of which heads configures a type of grip susceptible to being fixed to the upper edge of the shiftable leaf without needing holes or any other type of machining of the latter, specifically by simple tightening of said grip and by means of introducing sheets of an anti-slipping material between the grip and the shiftable leaf.

DESCRIPTION OF THE INVENTION

Maintaining the features of the previously mentioned patent in terms of the means of fixing each sliding door to its rolling elements, without any type of manipulation on the glass plate constituting said sliding door which may entail a risk of damaging or breaking it, the device proposed by the invention constitutes a technological advance in this field, enabling two sliding doors suspended from the corresponding guide with the mechanisms of patent number 9600632 to furthermore be able to be actuated synchronously, both in the opening motion and in the closing motion thereof.

To that end and more specifically, each one of said grips for fixing the corresponding wheel to the upper edge of the sliding leaf has an extension to which there is fixed by means of screwing a connection part, with a forked, T-shaped profile, through which the two sections of a cog belt arranged between two end and also cogwheels pass such that while one of the sections of the belt is susceptible to being shifted longitudinally and freely with regard to the connection part for the interior thereof, the other section is rigidly joined to said part through a wedge which can be actuated with a screw, which means that when the longitudinal shifting of the connection part occurs, due to the mobilization of the door to which it is associated, a parallel mobilization of the cog belt occurs, synchronously transmitting motion to the connection part fixed to the other door and in inverted position, such that said doors either separate from or approach one another, but always with simultaneous and synchronized motions.

Starting from this basic structure, participating in the device are two pairs of cogwheels, linked within each pair by means of a cog belt, each pair being situated in correspondence with one of the doors and said belts being able to be aligned or form a certain angle, the wheels in either case being cogwheels and double, with one wheel for the main belt of its own pair, and with another one of a larger diameter through which it directly meshes with the wheel belonging to the second pair, for the synchronized motion of both cog belts.

It has complementarily been provided that the lower profile of the fixed leaves, which frames the sliding doors, incorporates a dovetail side groove implying optimal tongue-and-groove coupling conditions for the profile constituting the lower guide of the sliding leaves, a guide on which a sleeve limiting the allowance of said sliding leaf with regard to the guide, as well as stops limiting the run of the repeatedly mentioned sliding leaf, can be removably assembled.

DESCRIPTION OF THE DRAWINGS

To complement the description being made and for the purpose of aiding to better understand the features of the invention, according to a preferred practical embodiment thereof, a set of drawings is attached as an integral part of said description, in which the following has been depicted with an illustrative and non-limiting character:

FIG. 10 shows an elevational view of the lower stop of the previous figure.

FIG. 11 shows a plan, elevational and cut-away view of the upper stop for the sliding door intended for being fixed to the upper guide.

PREFERRED EMBODIMENT OF THE INVENTION

Figure 5:
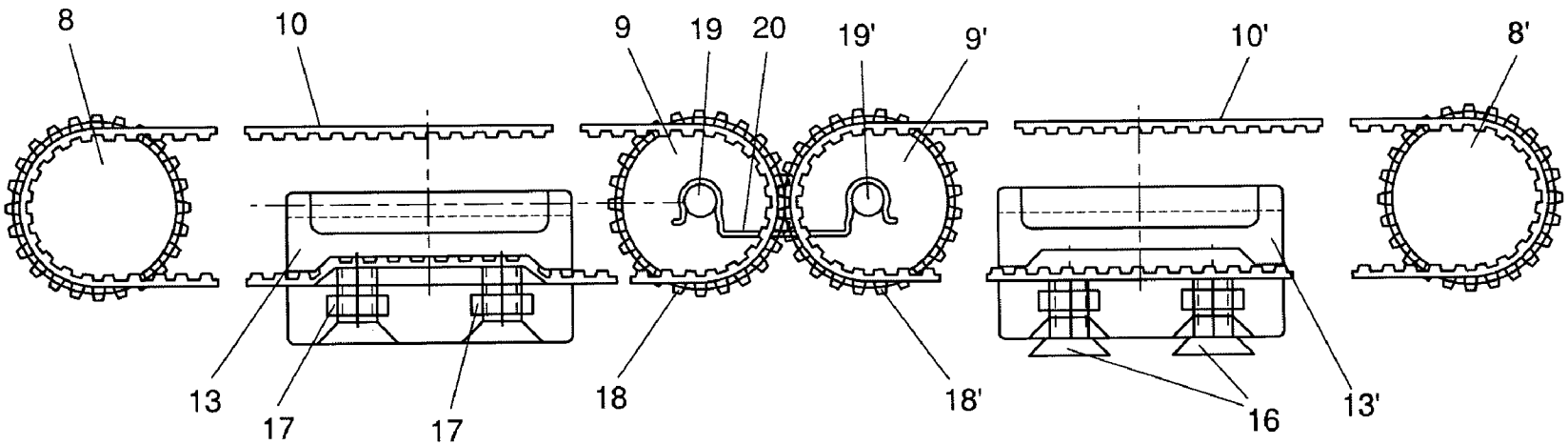
FIG. 5 shows a plan view of a detail of the device of the invention, in the case in which said device is intended for acting on a pair of coplanar sliding doors.
Figure 6:
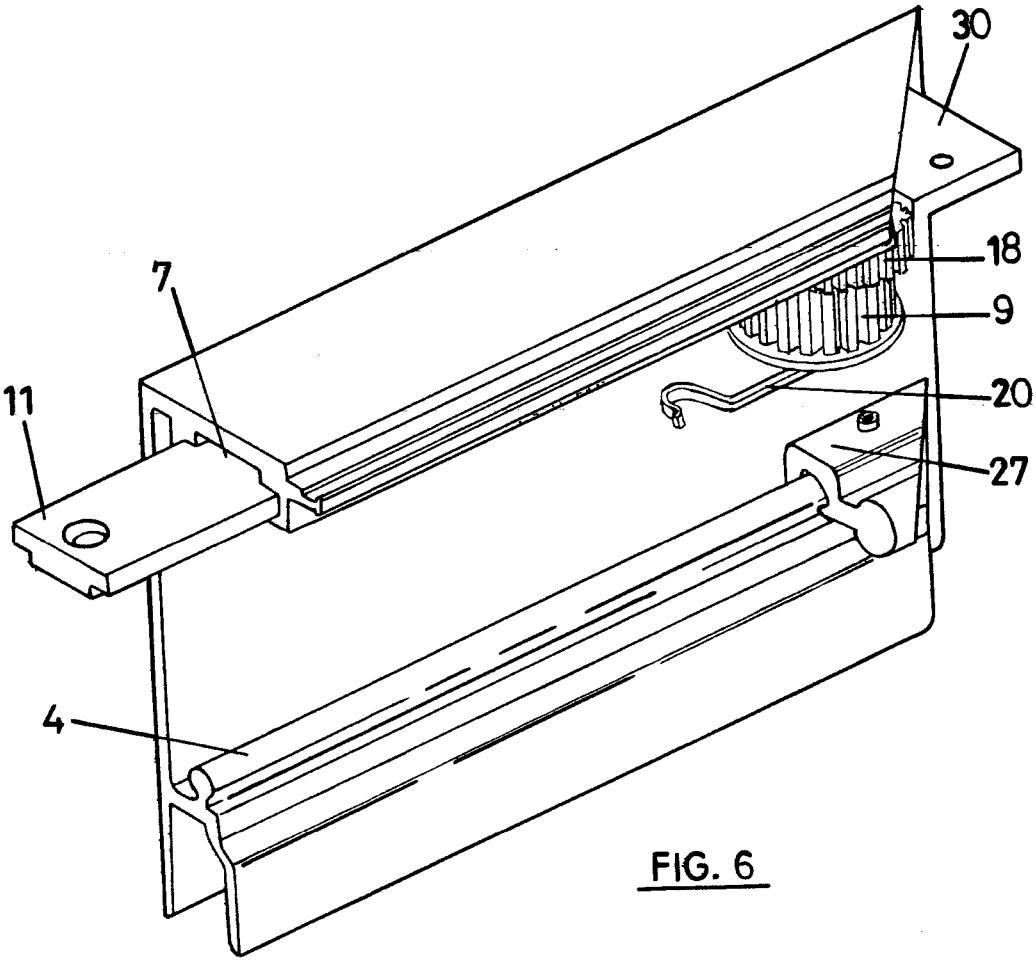
FIG. 6 shows a perspective view of a profile on which the device object of the present invention is assembled.
Figure 7:
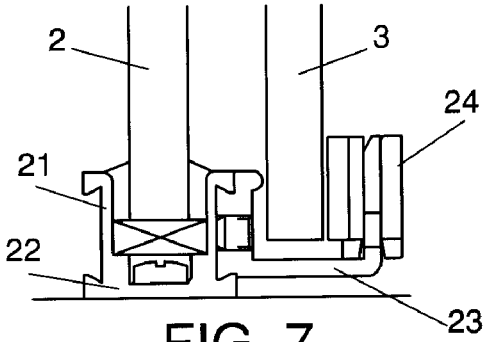
FIG. 7 shows a profile view of a detail of the lower guide of a sliding door, duly coupled to the profile of the fixed leaf with regard to the one which shifts.

In view of the mentioned figures, it can be observed how there is defined on the upper guide (1), equivalent to the one of patent number 9300632, duly fixed to the fixed leaves (2) and to the glass ends, as well as the sliding leaves (3-3') themselves, and with the same rib (4) for rolling of the wheels (5) which, by means of the grips (6-6'), are joined to the sliding leaf (3), a lower groove (7) of an approximately rectangular profile opening, on which there is assembled the device for the synchronized actuation of the sliding leaves (3-3'), constituting the object of the present invention and which is that which is especially depicted in FIG. 5.

Two modules participate in the mechanism, as can also be observed in said FIG. 5, each one of which is constituted by means of a pair of end cogwheels (8-8', 9-9'), between which a cog belt (10-10') extends, the shaft of both cogwheels (9-9') being assembled on a sliding guide shoe (11) functioning in the lower groove (7) of the upper guide (1) and which enables fixing the guide shoe (11) to the upper guide (1) by means of a stud bolt (12).

Figure 1:
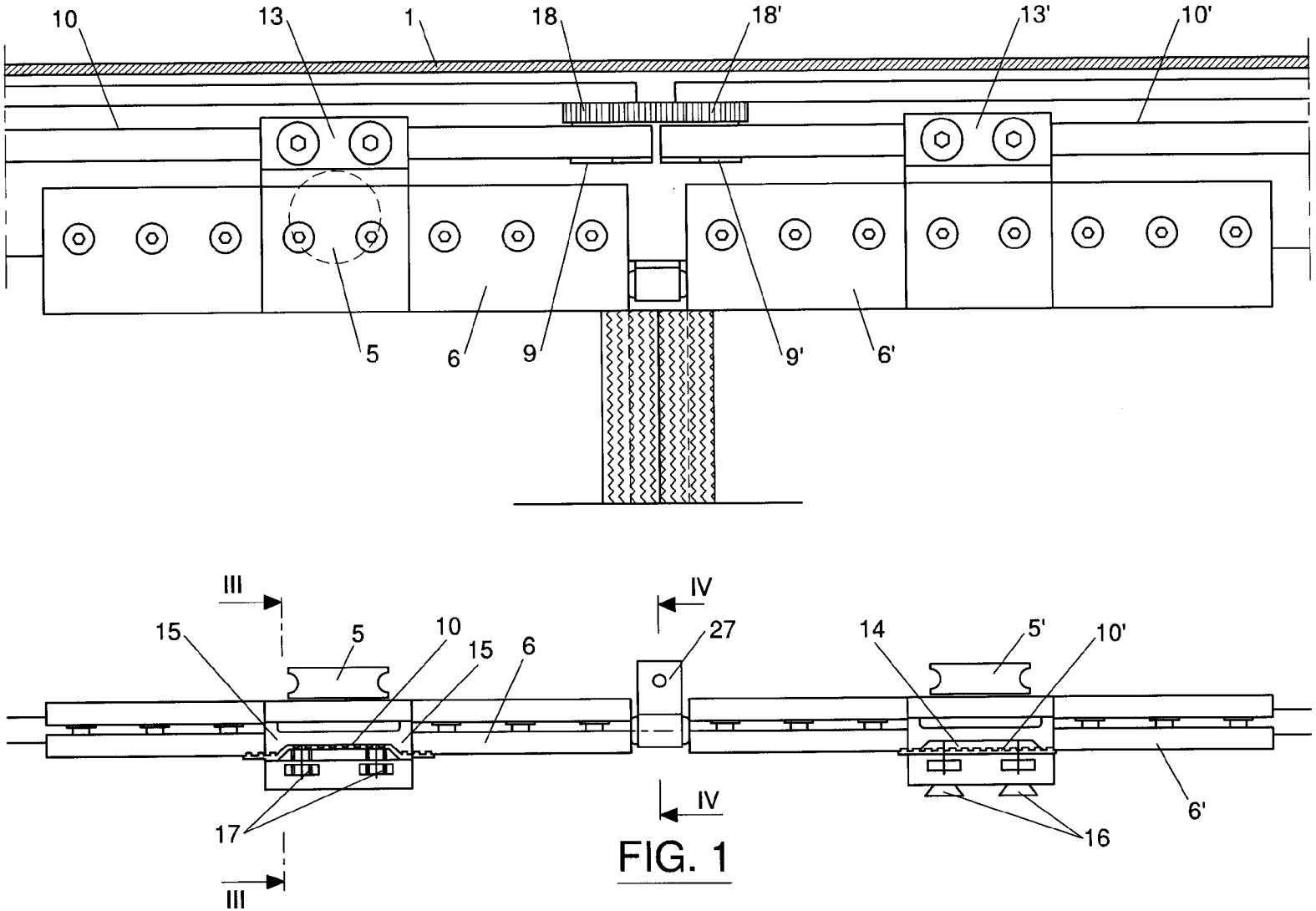
FIG. 1 shows a front elevational and upper plan view of a detail of the grips corresponding to two sliding doors, assembled on a common and upper guide, in the position of maximum closeness and with the device for the synchronized actuation of said doors constituting the object of the invention.
Figure 2:
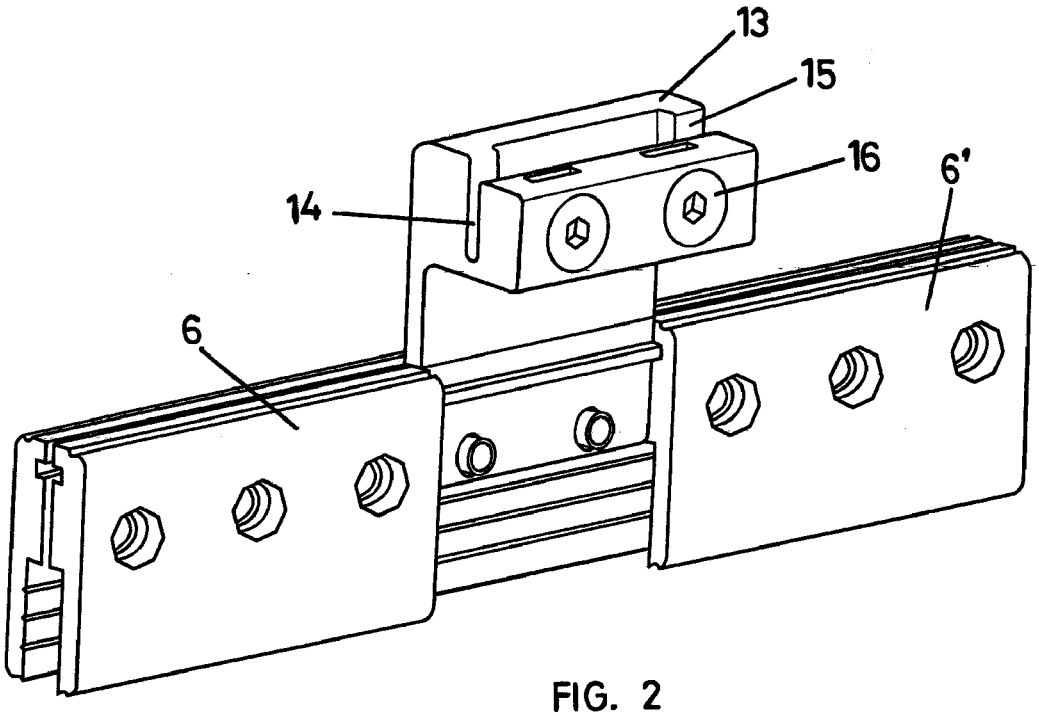
FIG. 2 shows a perspective view of the grips depicted in FIG. 1.

Each module of the device consists of a connection part (13-13') intended for being fixed to the corresponding cog belts (10-10') of each one of said modules, the connection pieces (13-13') adopting an inverted L-shaped profile, the vertical and lower branch of which is joined to the grip (6), as especially observed in FIG. 2, whereas its horizontal and upper branch is remarkably thickened and has a longitudinal groove (14) enabling the passing of the cog belt (10-10'), a groove (14) which narrows remarkably at its ends by means of inner projections (15) of the connection part (13-13') itself, such that when carrying out the tightening of locking screws (16), functioning in respective nuts (17) embedded in the connection part (13-13') itself, the cog belt (10-10') is pressed against the opposite side of the groove (14), producing a labyrinthine trajectory for it, especially visible in the plan view depicted in FIG. 1, ensuring absolute impossibility of relative shifting of the connection parts (13-13') with regard to the corresponding cog belt (10-10') of each module.

Figure 3:
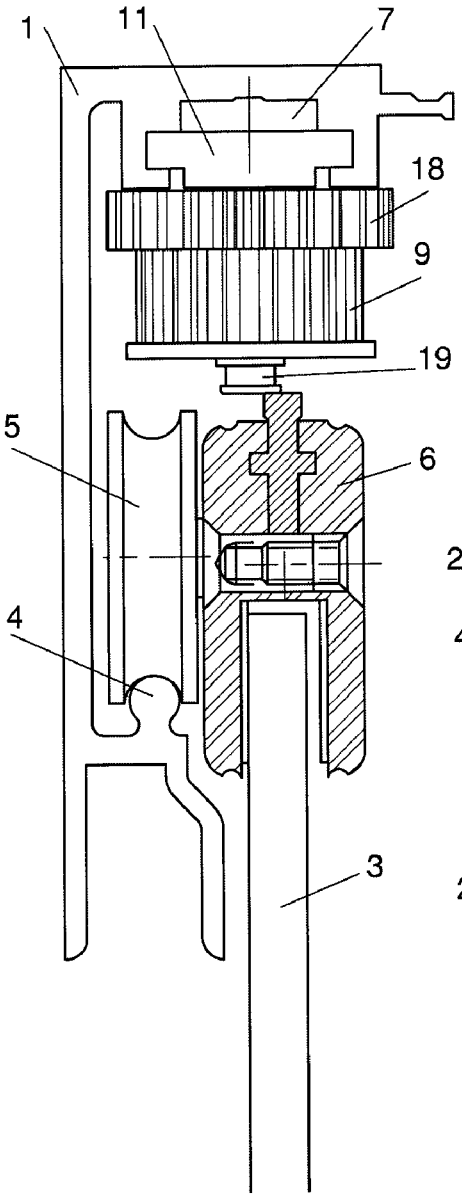
FIG. 3 shows a cut-away profile view of the assembly depicted in the previous figure, specifically cut away at the level of the shaft of the shifting wheel of one of the sliding doors.
Figure 4:
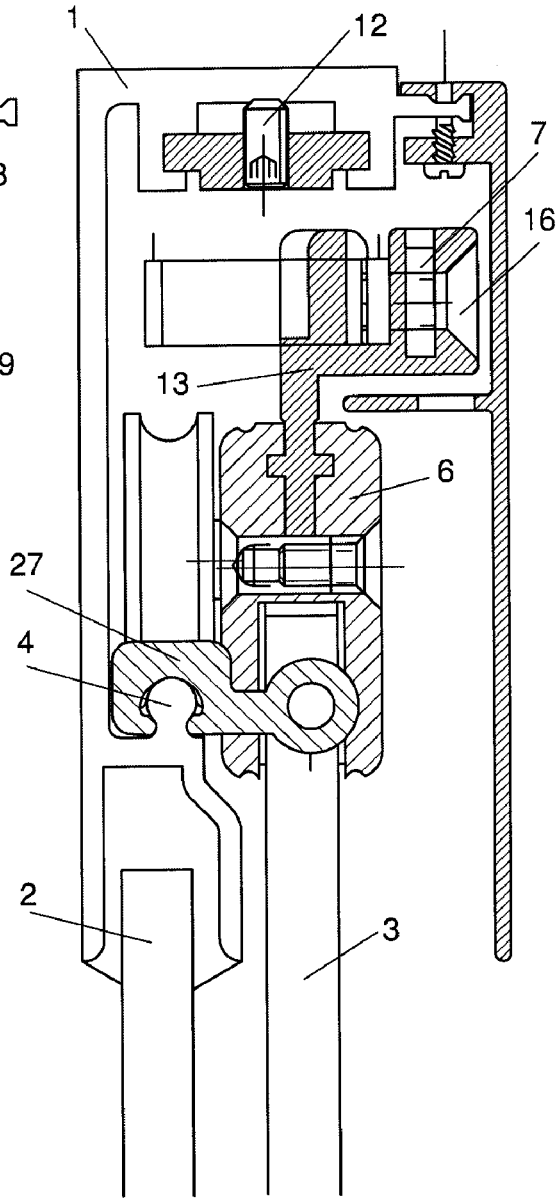
FIG. 4 shows a detail similar to that of the previous figure, but in which the cut is carried out at the level of the stop limiting the run for said sliding door.

To synchronize the motion between the two complementary modules, that is, between the two cog belts (10-10'), respective cogwheels (18-18') of a larger diameter meshing with one another are coaxially joined to the neighboring cogwheels (9-9') of both modules, as is also observed in FIGS. 3 and 5, these wheels (18-18') constituting the means of synchronized transmission of motion from one module to the other one and, accordingly, from one door to the other one. This implies that the cog belts (10-10') of the two modules of the door longitudinally shift in the opposite direction, therefore the respective connection parts (13-13') must be situated on the same side of said cog belts (10-10'), so that the simultaneous approaching or distancing thereof and, accordingly, of the sliding leaves (3-3') fixed to them, occurs.

Figure 13:
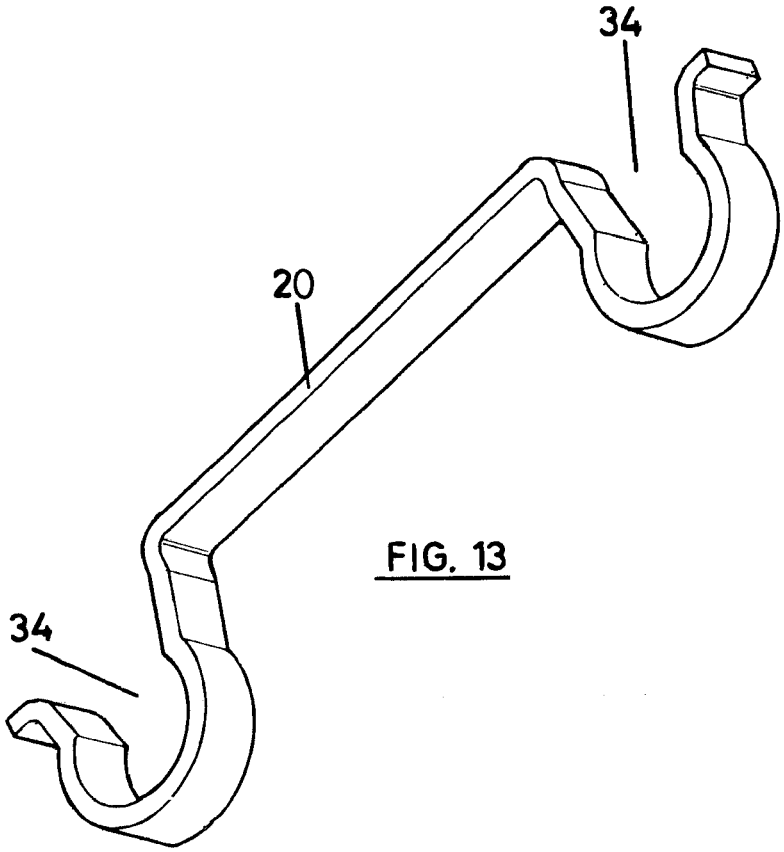
FIG. 13 shows a perspective view of one of the strips joining the respective shafts of the cogwheels of the two doors.

To maintain the cogwheels (18-18') duly meshed with one another, arranged between their respective shafts (19-19') there is a joining part, mote specifically a joining strip (20) having respective U-shaped curves at its ends, which curves have openings (34) of an increasing width, as shown in FIG. 13, said openings (34) facilitating the assembly of the joining strip (20) on said shafts (19-19') and thus maintaining the distance between them.

Figure 8:
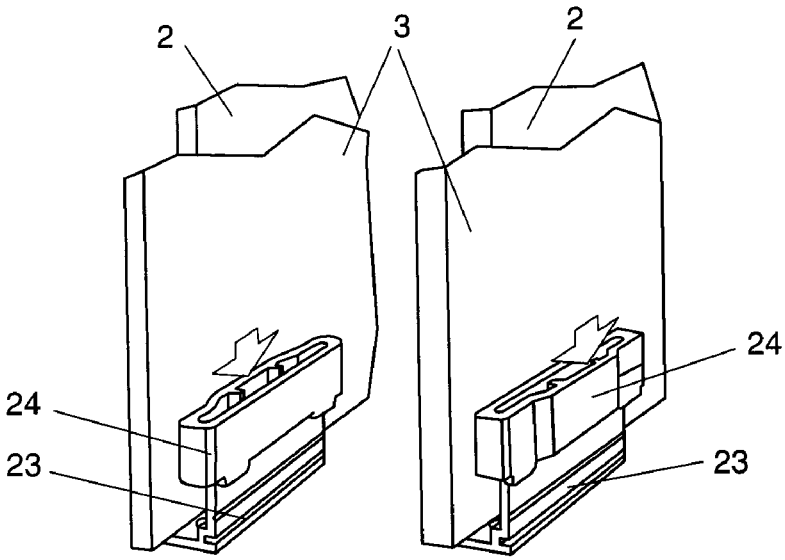
FIG. 8 shows a perspective view of a detail of the assembly depicted in the previous figure, in the two positions which are possible and provided for the sleeve limiting the clearance for the sliding leaf.

As a complement of the described structure, it has been provided that the fixing profile (21) for the lower edge of the fixed leaves (2) incorporates a dovetail groove (22) in its side branch facing the sliding leaf (3), providing two possibilities:

Firstly, it enables the coupling, by means of tongue-and-groove, of the lower guide (23) for the sliding leaf (3), with the collaboration of a sleeve (24) which can be inserted in its outer, asymmetrical and reversible branch, as shown in FIG. 8, to adjust at will the allowance of the sliding leaf (3) on the lower guide (23), as observed in FIG. 8.

Figure 9:
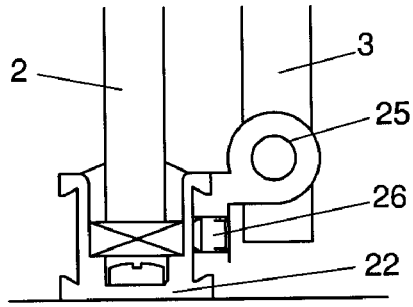
FIG. 9 shows a depiction similar to the one of FIG. 7, in which joined to the fixing profile of the lower edge of the fixed panel is the lower stop for the sliding door.

Secondly, the same dovetail groove (22) can be used for fixing a lower stop (25) to limit and brake the run of the sliding leaf (3), which is logically interposed in the trajectory thereof, a stop the structure of which is observed in detail in FIGS. 9 and 10 and which is fixed to the profile (21) with the collaboration of screws (26).

The upper rib (4) for shifting of the wheels (5) associated to the suspension grips (6-6') of the sliding leaf (3) has also been provided as a fixing means for a stop (27), the one depicted in FIG. 11, complementary of the lower stop (25), provided with a choked opening groove (28) for coupling to said rib (4), and with locking screws (29) for its final locking in the working position.

Figure 12:
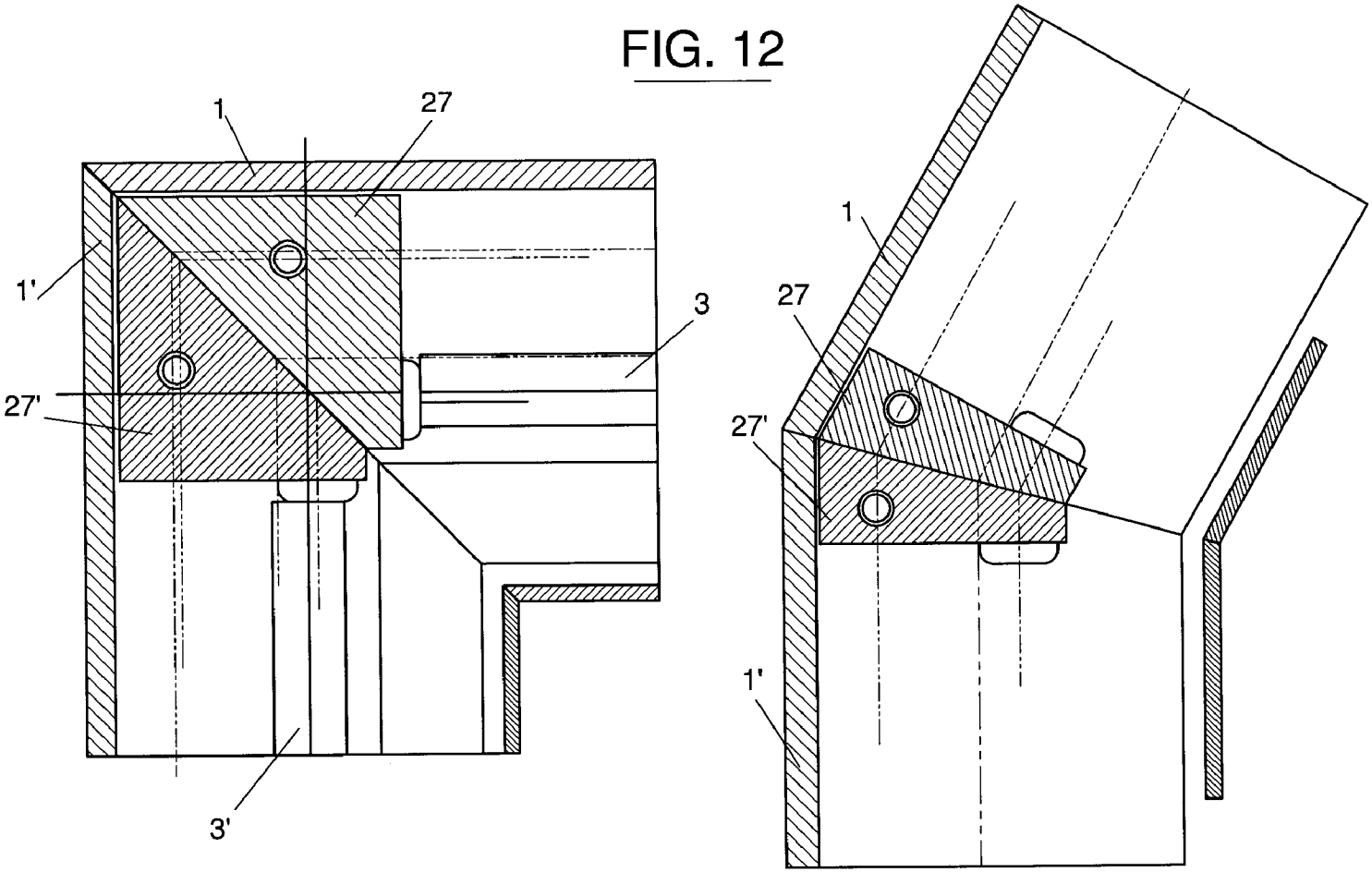
FIG. 12 shows a partial depiction of the profiles in the particular cases of two doors perpendicular to one another and two doors forming an obtuse angle, in which the arrangement of the corresponding upper stops is seen.

As previously stated, the two sliding leaves can be coplanar, such as in the depiction of FIG. 5, or they can form any angle, either a 90° angle or a 135° angle, as shown in FIG. 12, being of any other angle according to the needs of each case.

Figure 14:
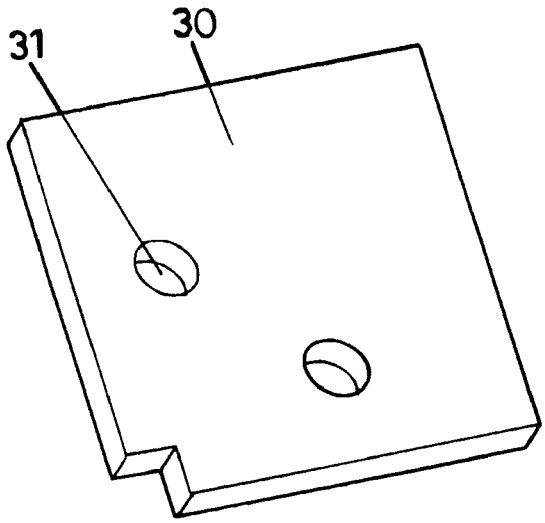
FIG. 14 shows a perspective view of the plates joining the ends of the upper guides of the doors.

For these angling cases, it has been provided that the two sections of the upper guide (1) forming said angle are joined to one another by means of a joining plate (30), which will be prefabricated and of a fixed angle adjusted to each particular case, as can be seen in FIG. 14 for the case of two perpendicular leaves. For this particular case, the plate has a square shape and arranged on each branch thereof are respective holes (31) intended for fixing the plate to the end of each section of the upper guide (1) of each one of the leaves of the door.

Figure 15:
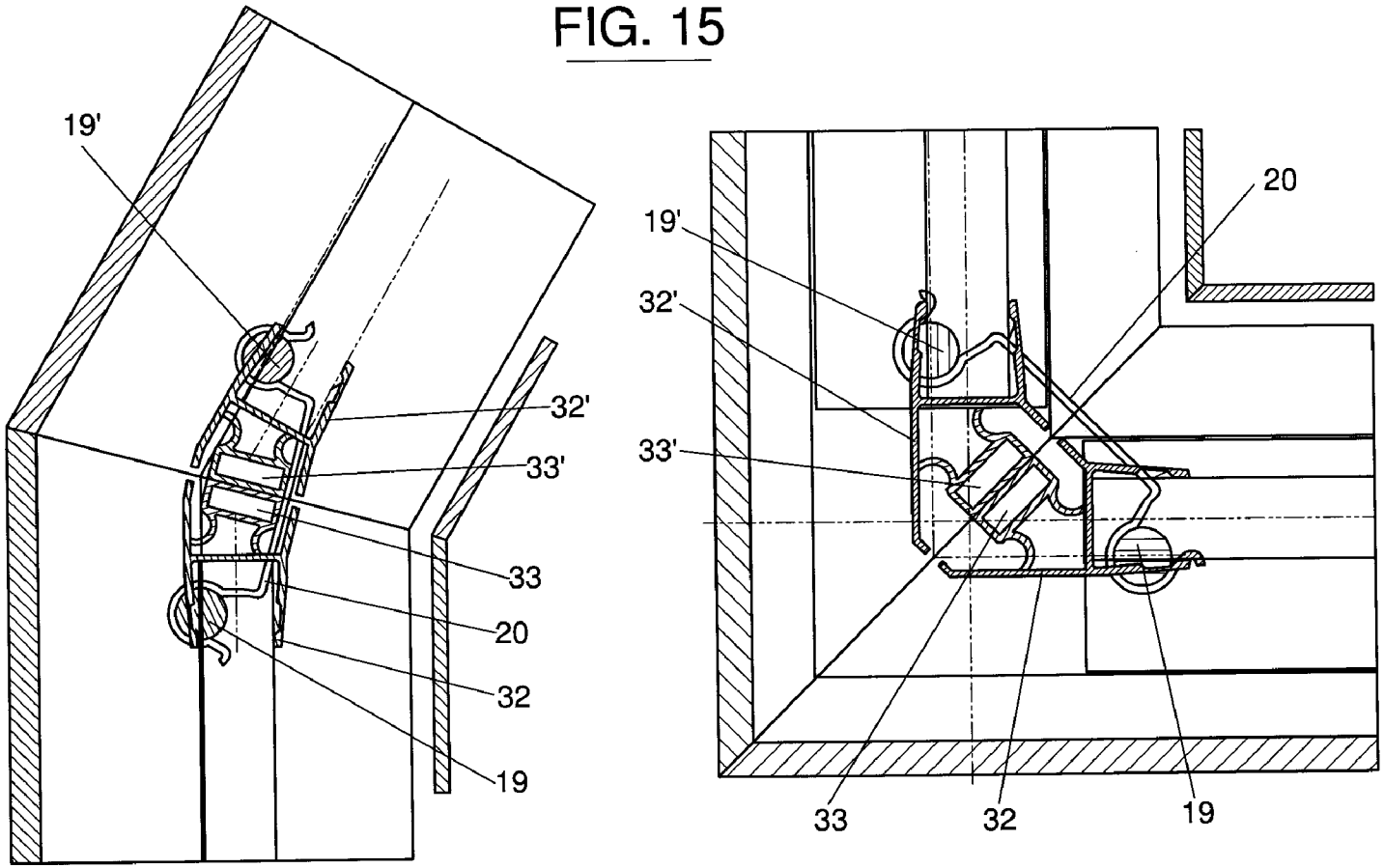
FIG. 15 shows a partial cut-away view of the devices protecting the edges of the leaves of the doors in the particular cases of two doors perpendicular to one another and two doors forming an obtuse angle.

FIG. 15 shows a particular case of two doors joined at one side perpendicularly, and at the other side forming an obtuse angle, each one of the doors has an element to protect the edges of the glass of each leaf and to furthermore secure their joining and sealed closing. As can be observed in FIG. 15, each element protecting the edges consists of a flexible body (32-32') which is perfectly coupled to the edge of the glass, being situated inside the profile (1), each one of said flexible bodies (32-32') having at its free end respective magnets (33-33') oriented with regard to the edge depending on the angle formed by the two doors with one another and placed in each flexible body (32-32') such that the surfaces of the magnets are facing in close contact, remaining joined due to the magnetic effect created by both magnets (32-32'), determining the fixing between the edges and, accordingly, between the leaves in a secure, sealed and easy to assemble manner.

The invention claimed is:

1. A device for synchronized actuation of sliding doors, the device comprising:

two sliding doors, each of the sliding doors comprising:

upper and lower guides and a lower profile, the lower profile including at least one side branch having a dovetail groove for coupling to the lower guide;

a fixed leaf coupled to the lower profile;

a sliding leaf slidably suspended from the upper guide and shiftable with respect to the fixed leaf along the lower guide;

proximal and distal cogwheels coupled to the upper guide;

a cog belt arranged over the proximal and distal cogwheels; and a stop having a tongue for being coupled to the at least one side branch of the lower profile, the at least one side branch being situated on a side of the lower profile facing the sliding leaf, the stop limiting and braking shifting of the sliding leaf; and a joining strip for joining the proximal cogwheels of the two sliding doors, wherein actuation of the sliding leaf of one of the two sliding doors in a selected direction is simultaneously and synchronously transmitted to the sliding leaf of the other of the two sliding doors.

2. A device for synchronized actuation of sliding doors according to claim 1, wherein each of the sliding doors further comprises:

one or more coupling grips coupled to an upper edge of the sliding leaf, the one or more coupling grips further comprise wheels for shifting the sliding leaf on the upper guide; and at least one connection part for fixing the one or more coupling grips to the cog belt for causing the cog belt to shift the sliding leaf, wherein the at least one connection part comprises:

a vertical lower branch and a horizontal upper branch, the horizontal upper branch having a middle longitudinal groove extending along the at least one connection part, said at least one connection part comprises an approximately L-shaped profile, wherein the vertical lower branch is fixed to the one or more coupling grips and the middle longitudinal groove enabling passing of the cog belt coupled to the at least one connection part through the groove; and a pair of locking screws and nuts in the at least one connection part for coupling the connection part to the cog belt.

3. A device for synchronized actuation of sliding doors according to claim 1, wherein each of the sliding doors further comprises a linking shaft positioned at a center of the proximal cogwheel, the joining strip linking the linking shaft of each of the two sliding doors.

4. A device for synchronized actuation of sliding doors according to claim 1, wherein the lower guide further comprises:

a tongue branch for tongue-and-groove coupling of the lower guide to the at least one side branch of the lower profile;

a side guide branch opposite to the tongue branch; and an asymmetrical sleeve removably inserted into the side guide branch, a reversible assembly of the sleeve enables adjusting a distance of sliding of the sliding leaf within the lower guide by removing, reversing, and re-inserting the sleeve into the side guide branch.

5. A device for synchronized actuation of sliding doors according to claim 1, further comprising a joining plate for joining the upper guide of each of the two sliding doors, the joining plate positioning the two sliding doors at a first angle to each other, selected from a plurality of angles varying from about 180° to about 90°.

6. A device for synchronized actuation of sliding doors according to claim 5, wherein each of the sliding doors further comprises:

an element for protecting a first corner of the sliding leaf nearer to the proximal cogwheel, the element having a flexible body and first and second ends; the first end of the element being mounted on the first corner of the sliding leaf; and a magnet coupled to the second end of the element, the magnet being positioned to correspond to the first angle.

7. A device for synchronized actuation of sliding doors according to claim 1, wherein the fixed and sliding leaves are made of glass.

* * * * *